United States Patent [19]

Lewis et al.

[11] 4,426,436

[45] Jan. 17, 1984

[54] PROCESS FOR POSITIVE CHARGE SHARING TONER COMPOSITIONS

[75] Inventors: Richard B. Lewis, Williamson; Paul C. Julien, Webster; Robert J. Gruber, Pittsford; Richard F. Koehler, Jr., Webster, all of N.Y.

[73] Assignee: Xerox Corporation, Stamford, Conn.

[21] Appl. No.: 296,609

[22] Filed: Aug. 26, 1981

[51] Int. Cl.[3] ..... G03G 21/00

[52] U.S. Cl. ..... 430/137; 430/106.6; 430/109; 430/111

[58] Field of Search ..... 430/106.6, 109, 110, 430/111, 137

[56] References Cited

U.S. PATENT DOCUMENTS

| | | | |
|---|---|---|---|
| 2,919,247 | 12/1959 | Allen | 430/110 |
| 2,965,573 | 12/1960 | Gundlach | 430/110 |
| 3,576,744 | 3/1971 | Sharrock et al. . | |
| 3,838,054 | 9/1974 | Trachtenberg et al. | 430/106.6 |
| 3,893,935 | 7/1975 | Jadwin et al. . | |
| 3,944,493 | 3/1976 | Jadwin et al. . | |
| 3,960,738 | 6/1976 | O'Brien et al. . | |
| 3,970,571 | 7/1976 | Olson et al. . | |
| 3,983,045 | 9/1976 | Jugle et al. | 430/110 |
| 4,070,186 | 1/1978 | Gibson et al. . | |
| 4,079,014 | 3/1978 | Burness et al. . | |

FOREIGN PATENT DOCUMENTS

| | | | |
|---|---|---|---|
| 56-19058 | 2/1981 | Japan | 430/106.6 |
| 1204861 | 9/1970 | United Kingdom | 430/110 |

OTHER PUBLICATIONS

IBM Tech. Discl. Bull., vol. 21, No. 8, Jan. 1979, p. 3091, "Anti-Caking Agent for Toner".

Res. Discl. 9502, Prod. Lic. Index, Mar. 1972, pp. 32–35, "Toner Concentration Control Apparatus".

*Primary Examiner*—Roland E. Martin, Jr.

*Attorney, Agent, or Firm*—E. O. Palazzo

[57] ABSTRACT

This invention relates to a process for rapidly charging uncharged toner particles to a positive polarity, which comprises adding uncharged toner particles to a positively charged developer composition comprising carrier particles and toner particles, the charged and uncharged toner particles containing conductive particles or conductive patches on their surface, which conductive patches are of a higher positive triboelectric charge than the toner polymer, contacting the charged toner particles with the uncharged toner particles causing positive charges to be transferred from the conductive particles on the charged toner particles, to conductive particles on the uncharged toner particles, within a period of from about 5 seconds to about 2 minutes, thereby resulting in substantially the same level of positive charge intensity for both the original charged toner particles and the added toner particles, such charge intensity ranging from about 5 microcoulombs per gram to about 50 microcoulombs per gram.

9 Claims, 4 Drawing Figures

ADMIXING WITHOUT AND WITH
CONDUCTIVE SURFACE PARTICLES
FIG. 1a ADMIX WITHOUT CONDUCTIVE SURFACE PARTICLES
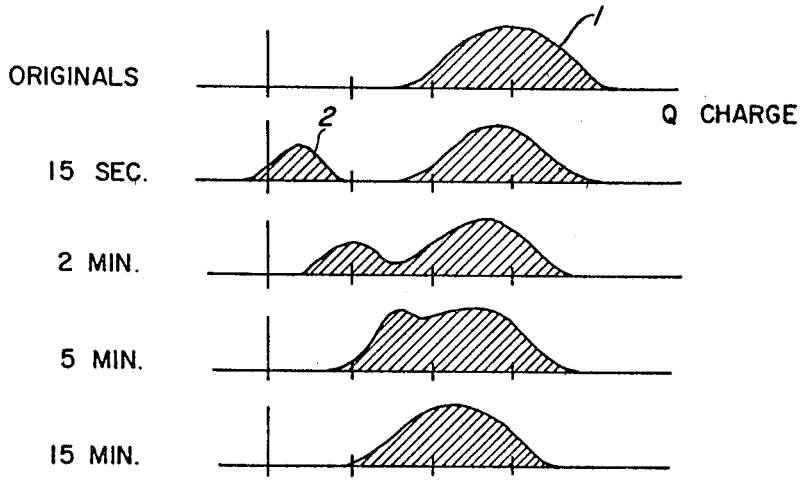
FIG. 1b ADMIX WITH CONDUCTIVE SURFACE PARTICLES
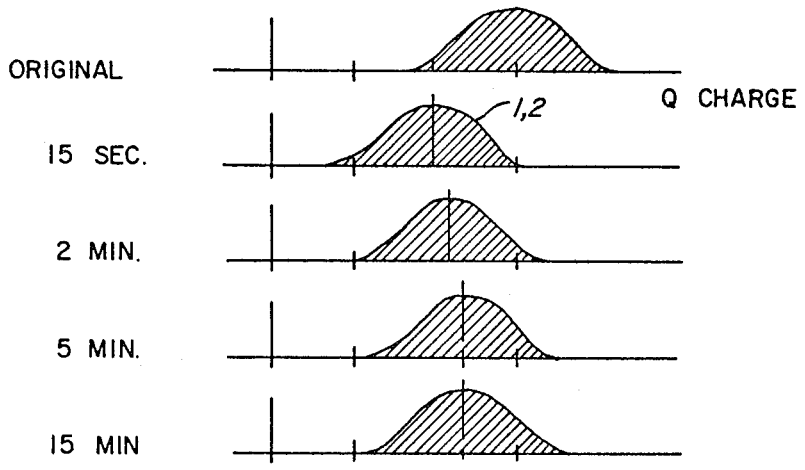

FIG. 2 CHARGE SHARING
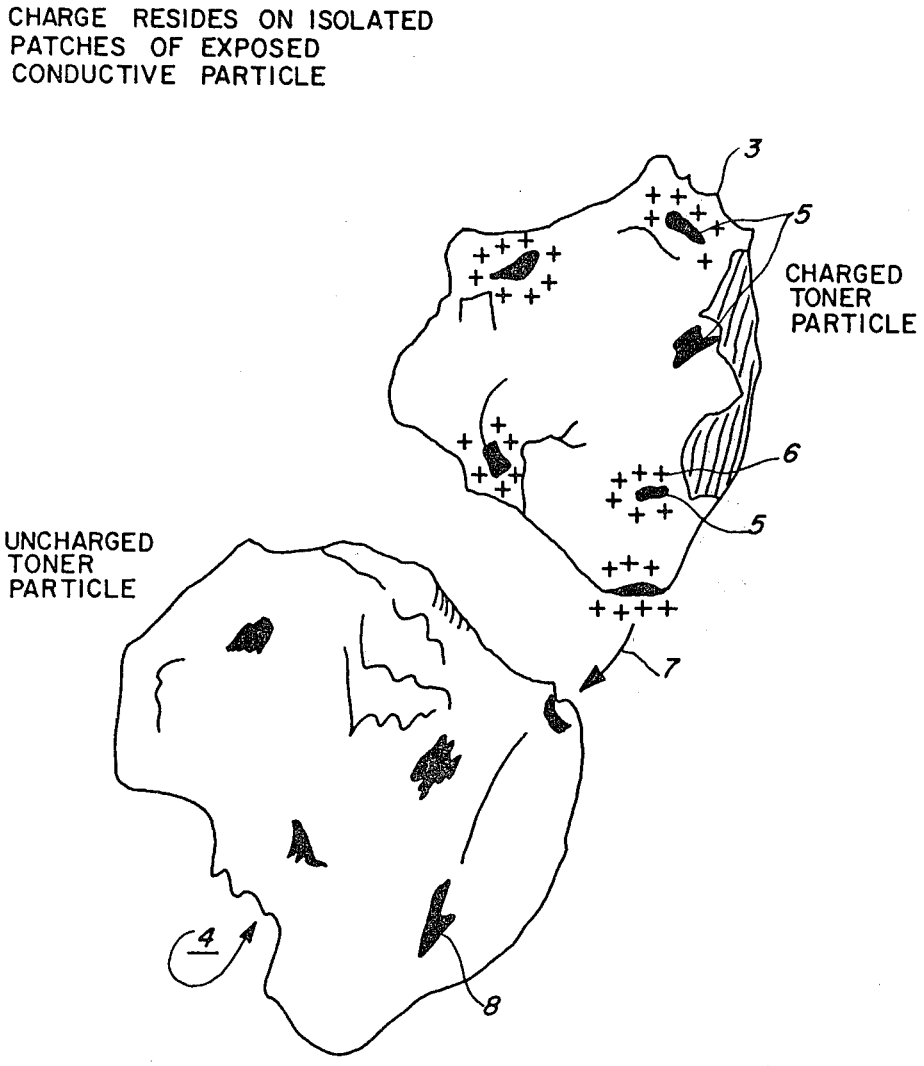

TRIBOELECTRIC SERIES

PROCESS FOR POSITIVE CHARGE SHARING TONER COMPOSITIONS

BACKGROUND OF THE INVENTION

This invention is generally directed to a system and process for designing positive charge sharing toner compositions, and more specifically the present invention is directed to a process for rapidly charging uncharged toner particles to a positive polarity, which toner particles are useful for causing the development of electrostatographic images, wherein the electrostatic latent image to be developed contains negative charges.

The electrostatographic process, and more specifically, the xerographic process is well known, as documented in several prior art references. In these processes, an electrostatic latent image is developed by applying toner particles thereto using, for example, the cascade development method as described in U.S. Pat. No. 3,618,552, or magnetic brush development as described in U.S. Pat. Nos. 2,874,063 and 3,251,706. In some instances, as indicated herein, it may be desirable in such systems to produce a reverse copy of the original, thus, for example, it may be desired to produce a negative copy from a positive original, or a positive copy from a negative original.

In cascade development, developer material comprising relatively large carrier particles containing oppositely charged finely divided toner particles electrostatically clinging to their surface are conveyed to and rolled or cascaded across the surface bearing the electrostatic latent image. The charged portions of the surface, generally a photoconductive surface, have a charge of the same polarity as the carrier particles, however, such charge is usually much stronger than the charge on the carrier particles. Thus, as the developer mixture cascades or rolls across the image bearing surface, the toner particles are electrostatically attracted from the carrier particles to the charged portions of the image-bearing surface, whereas they are not electrostatically attracted to the uncharged or background portions of the image which they contact. The carrier particles, and unused toner particles are then recycled.

Magnetic brush development involves essentially the same steps as cascade development with the primary exception being that in magnetic brush development, developer material comprising relatively large magnetic carrier particles and finely divided toner particles electrostatically clinging to the surface of the carrier particles are conveyed to and drawn across the surface bearing the electrostatic latent image by a roller containing magnets.

In order to develop a negatively charged electrostatic latent image a toner and carrier combination is selected wherein the toner is triboelectically positive in relation to the carrier, while for the development of a positively charged electrostatic image, a toner and carrier combination is used wherein the toner is triboelectrically negative in relation to the carrier material. In these systems the triboelectric relationship between the toner particles and carrier particles depends on the relative positions of the materials in the triboelectric series. In this series materials are arranged in ascending order of their ability to assume a positive charge, thus each material is positive with respect to any material classified below it in the series, and negative with respect to any material above it in the series. An example of such a triboelectric series is illustrated in FIG. 3.

There is also known the use of certain charge control agents for the purpose of imparting a positive charge to the toner resin. For example, the use of quaternary ammonium salts as charge control agents for electrostatic toner compositions is disclosed in U.S. Pat. No. 3,893,935. According to the disclosure of this patent, certain quaternary ammonium salts when incorporated into toner materials were found to provide a toner composition which exhibited relatively high uniform and stable net toner charge, when mixed with a suitable carrier vehicle. U.S. Pat. No. 4,079,014 contains a similar teaching with the exception that a different charge control agent is used, namely a diazo type compound.

Many of the above described developers have a tendency to lose their positive charge over a period of time. Also, certain charge control additives are incompatible with the thermoplastic resin, causing difficulties in uniformly dispersing or dissolving such materials in the toner composition. Additionally, chemically active charge control agents can adversely effect machine components such as seals, rubber rolls, and the like. Thus, it would be desirable to provide a chemically inert toner charging means.

Furthermore, during the operation of an electrostatographic imaging device, toner particles being consumed must be constantly replenished. The amount of toner added to the developer composition depends on a number of factors including the number of images developed per minute, the percentage area of the image on the paper, the darkness of the image, the size of the toner particles, and the like. Generally, the amount added ranges from about 1 to about 20 percent per minute of the total amount of the toner in the developer. When replenishing the developer material, that is, toner plus carrier, used in commercial electrostatographic devices, the newly added toner does not contain any charge thereon, that is, its charge is neutral. In order for the toner to properly cause development of an electrostatic latent image the newly added toner must be charged to the appropriate level, which could consume a substantial period of time, up to about one hour depending on the materials used and other parameters of the system. This long time delay can adversely affect the system in that the toner particles that possess no charge, or a low charge can be printed out as undesirable background material. Also, uncharged toner particles will in general result in contaminated machines in view of the deposition of such particles on machine parts, thereby eventually causing failure of corotrons, filters, and the like. Such failures are not only costly, but also result in images of low quality.

Accordingly, there is a need for a system, and more particularly a process wherein newly added uncharged toner particles contained in a positively charged developer composition can acquire positive charge at the appropriate level and magnitude over a short period of time, by sharing positive charges with charged toner particles previously present in the developer composition. This is referred to herein as positive charge sharing.

SUMMARY OF THE INVENTION

It is a feature of this invention to provide a system and process which overcomes the above-noted disadvantages.

It is a further feature of the present invention to provide a developer composition, which contains toner particles and carrier particles, with the toner particles being charged positively.

Another feature of the present invention is the provision of a process wherein a developer composition which contains positively charged toner particles share their positive charges with new uncharged toner particles, being added thereto.

Yet another feature of the present invention is the provision of a process wherein toner compositoins can be used to develop electrostatic images containing negative charges on an imaging surface, which compositions will transfer effectively electrostatically from such a surface to plain bond paper without causing blurring, or adversely affecting the quality of the resulting image.

These and other features of the present invention are accomplished by using a matrix of materials which will enable a process for causing uncharged toner particles to acquire a positive charge over a relatively short period of time, when such particles are added to a developer composition previously charged. The charging of the new uncharged toner particles is accomplished by a process referred to herein as positive charge sharing, which process continually equalizes the charge on all the same size toner particles in a developer composition to substantially the same level. Thus, in accordance with the present invention, when uncharged toner particles are added to a charged developer mixture, charge transfers rapidly from the original toner materials that are charged, to the uncharged toner particles, thereby allowing the charges to be substantially evenly distributed on all the toner particles, including those which were added to the system in an uncharged state. Subsequently additional positive charges may be imparted to the toner particles as a result of the triboelectric relationship between the toner particles and the carrier particles.

More specifically, in one embodiment the present invention is directed to a process for rapidly charging toner particles to a positive polarity, which comprises adding uncharged toner particles to a charged developer composition comprised of carrier particles and positively charged toner particles, the uncharged and charged toner particles containing conductive particles or conductive patches on their surface, such conductive particles being for example materials like carbon black, yttrium oxide-doped zirconium oxide, and the like; contacting the charged toner particles with the uncharged toner particles, causing positive charges to be transferred from the conductive particles on the charged toner particles, to conductive particles on the uncharged toner particles within a developer mixing or blending period of from about 5 seconds to about 2 minutes, thereby resulting in substantially the same level of positive charge intensity for both the originally charged toner particles, and the added toner particles, such charge intensity ranging from about 5 microcoulombs per gram to about 50 microcoulombs per gram. The conductive patches are of a higher positive triboelectric charge than the toner polymer.

In accordance with the process of the present invention, the conductive particles or conductive patches present on the charged toner particles contain the bulk or a major portion, about 50 percent or more, of the positive charge that the carrier particles impart to the toner particles, which carrier particles are triboelectrically more positive than the toner resin. It is important that the conductive particles or patches contained on the toner surface contact the uncharged toner particles, in order that the positive charges contained on said patches may migrate or transfer by conduction to the uncharged toner particles, however, it is not necessary for all the conductive particles on the toner surface to contact the uncharged toner particles. The new uncharged toner particles being added are thus, in accordance with the proces of the present invention, rapidly charged to a suitable level, to enable them to be utilized for the development of images. Subsequently, the toner particles contained in the developer composition may then be triboelectrically charged further by the carrier particles present in the same developer composition.

DESCRIPTION OF DRAWINGS AND PREFERRED EMBODIMENTS

This invention will now be illustrated with reference to the following Figures wherein:

FIG. 1, which is comprised of FIG. 1A and FIG. 1B represents generally a plot of the number of toner particles at a given charge intensity for a uniform toner particle size.

FIG. 2 illustrates charged and uncharged toner particles containing conductive patches thereon, and as shown positive charges transfer from the patches contained on the charged toner particles to the uncharged toner particles.

Figure 3:
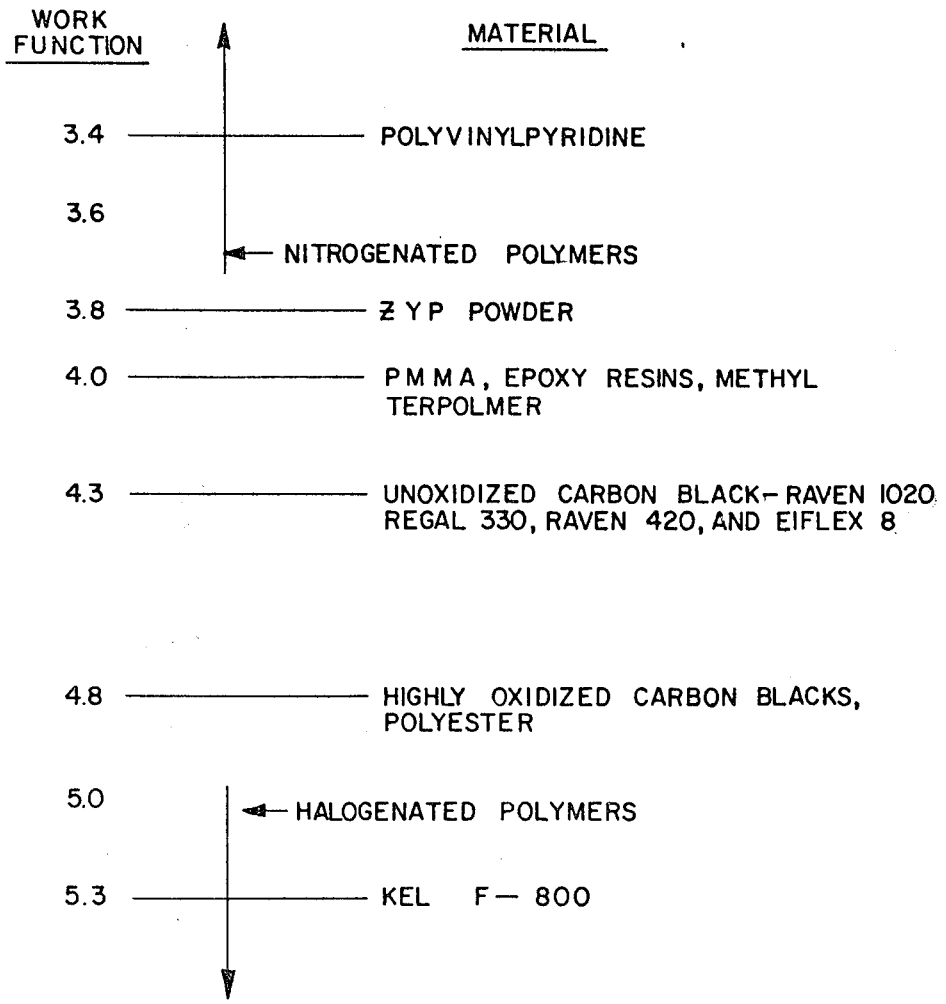
FIG. 3 illustrates a triboelectric series as more fully explained hereinafter.

More specifically, there is illustrated in FIG. 1, toner particle charge distributions which are plots of the number of particles at a given charge value for a particular narrow size range of toner particles, as measured by the use of a device, such as a charge spectrograph, described in copending appliation, U.S. Ser. No. 186,981, filed on Sept. 20, 1980 in the names of R. B. Lewis, E. W. Connors, and R. F. Koehler. The charge contained on toner particles in a given developer will in general vary considerably according to the size of the toner particles, accordingly, with reference to the charges contained on toner particles as being equal or unequal, it is meant that the charges are equal or unequal within any given size class of such particles.

With further reference to FIG. 1, FIG. 1A illustrates the behavior of a developer composition that does not exhibit the features of the present invention, while FIG. 1B illustrates the behavior of a developer compositon which exhibits the features of the present invention. More specifically, in FIGS. 1A and 1B the toner charge distribution labeled "original" are for developer compositions that have been well-mixed by tumbling on a roll mill for about one hour, and have thus reached an equilibrium condition of toner charge, defined as one that will not change with further mixing. The toner charge distributions labeled "15 seconds" are for developers made by adding uncharged toner to a well-mixed "original" developer, and then mixing for a further 15 seconds. Similarly the toner charge distributions identified by 2 minutes, 5 minutes, and 15 minutes, refer to correspondingly longer mixing times after the addition of fresh toner to a well-mixed developer.

With reference to FIG. 1A, the toner particles in the original, 1, well-mixed developer, which toner particles do not contain conductive particles have a distribution represented by about some average charge, Q, but no toner particles have a charge near zero as is evident from the graph. When fresh toner particles containing no conductive surface particles are added to this developer and blended for 15 seconds, such added toner particles initially have a charge of near zero, reference numeral 2, in the charge distribution labeled 15 seconds. With subsequent mixing the added toner particles 2 acquire higher charge levels as shown in the remaining plots of FIG. 1A. After 15 minutes of mixing the toner particle charges merge to a single peak and the developer has reached a new, well-mixed state characteristic of its new toner concentration level, and contains no toner particles near zero charge. For shorter mixing times, however, there remain two peaks and a considerable number of toner particles containing little or no charge. The time required for the original toner and the added uncharged toner to form a single peak, which does not narrow upon further mixing, is referred to as the charging admixing time of the developer composition. It is, of course, to be appreciated that while in this illustration 15 minutes is rquired in order to obtain proper charge admix, such a time can vary considerably ranging from perhaps in excess of 10 minutes up to an hour, and this is undesirable as explained herein.

FIG. 1B illustrates the behavior of a developer composition which exhibits the features of the present invention. The developer composition of FIG. 1B contains conductive surface particles on the toner, which developer composition, in this illustration, is comprised of the toner particles, the carrier particles, and the conductive particles, as described in working Example III. In accordance with the process of the present invention, charge admix occurs within about 15 seconds as illustrated. There has thus resulted after 15 seconds of mixing time a single peak indicating rapid charge transfer from the charged toner particles to the uncharged toner particles. Accordingly, such a developer composition is immediately suitable for the development of electrostatic images. Also as shown in FIG. 1B, the toner particles may subsequently move as a single peak to a higher charge, after two minutes and then five minutes of mixing, however, it is important to note that even after 15 seconds, there are no low charge or zero charge toner particles.

Illustrated in FIG. 2 are positively charged toner particles 3, uncharged toner particles 4, conductive particles or patches 5, positive charges 6, which positive charges transfer as shown by the arrow 7 to the conductive particles 8, on the uncharged toner particles, as a result of contact between the conductive particles of the charged toner particles and those of uncharged toner particles. The charges are thus transferred from the conductive patches 5 to the conductive patches 8, which contain no charges thereon. Accordingly, the positive charges residing mainly on the conductive particles on the charged toner particles are transferred, in view of the higher electrical potential on the charged toner particles, to the uncharged toner particles, as a result of contact therebetween. When mixing such particles together, only a fraction or only relatively few of the conductive particles need be contacted to produce approximately the same potential, and hence the same charge on all toner particles.

Illustrative examples of conductive surface residing particles, useful in the present invention, which particles can be in the form of patches on the toner particles, include those materials which are conductive and triboelectrically positive with respect to the toner resin. Accordingly, the conductive particles may comprise materials which have a resistivity in the range of from $10^9$ ohms/cm, (semiconductor), to $10^{-6}$ ohms/cm (conductor) providing that the particles can be prepared in submicron sizes. Specific examples of the conductive surface residing particles include metals such as gold or copper, semiconductor materials such as silicon, germanium, or carbon black, conductive metal oxides such as magnetite, reduced titanium oxide, doped antimony-oxide, tin oxide, and yttrium-oxide doped zirconium oxide, conductive organic polymers, such as doped polyacetylene, and semi metals such as carbon. Examples of preferred materials utilized in the process of the present invention include various conductive carbon blacks, such as Regal 330 carbon black, and Raven 420 carbon black, a solid solution of yttrium oxide and zirconium oxide, particularly a solid solution comprised of 12 percent of yttrium oxide and zirconium oxide, (ZYP powder) which materials can be positively charged with respect to common toner resins, particularly styrene and vinyl chloride dominated resins. Generally any conductive material can be employed providing that it can be made in particles less than about 1 micron in size, however, from a practical standpoint, such materials should be stable in air and economically attractive. Further, it is to be appreciated that as the conductive particles should dominate the triboelectric charging, certain conductive particles may be more suitable with regard to certain carrier coating compositions and certain toner polymers. For example, when the conductive material is mixed with the toner resins, and the resulting composite attritted in accordance with known methods to form toner particles, it is critical that the conductive material be more positive than the toner polymer in the triboelectric series.

This is more clearly illustrated with reference to FIG. 3 which represents a triboelectric series in terms of work functions, in volts, for the different materials listed, with PMMA being a polymethylmetharylate, KEL F-800 is a copolymer of chlorotrifluoroethylene and vinylidene fluoride and the other materials are as listed, and/or as indicated herein. Thus, for example, the work function in volts for polyvinyl pyridine is 3.4, while the work function for unoxidized carbon blacks, polyesters, and gold is 4.3, and the work function for highly oxidized carbon blacks, and polystyrene is 4.8. The work function numbers in volts for conductors are generally determined by the contact potential method, as illustrated in W. A. Zisman, *Review of Scientific Instruments,* Vol. 3, page 367, (1932), the disclosure of which is totally incorporated herein by reference, while the effective work function numbers for polymers are generally obtained by determining the sign of the charge when the polymers are contacted with conductors of known work function. Therefore, once the effective work function of a polymer has been determined, likely candidates for positive charge sharing conductive patches when used with a given toner polymer can be arrived at by measuring the contact potential of the material, usually relative to gold or some other convenient standard of known work function, and comparing it to the value for the polymer material. Thus, with polystyrene (work function=4.8 V.), highly oxidized carbon blacks would probably not yield suitable positive charge sharing agents since they have about the same work function. However, unoxidized carbon blacks with their lower work function (higher contact potential) would be quite suitable. Since polyester resins are at about the same work function level as the positive carbon blacks, these blacks would not be suitable positive charge sharing agents with this resin, and certainly the oxidized blacks lying more negative would not be suitable, however, in this situation, ZYP powder lying more positive would be a suitable candidate.

In order to generate a significant charge on conductive particles or conductive pigments, an essential criterion for charge sharing, the toner polymer resin and carrier surface are selected from materials in close proximity, from a location standpoint in the triboelectric series, while the conductive particles are selected so as to be substantially more positive, than the toner polymer, and carrier. The conductive particles must be more triboelectrically positive than the toner resin, which resin should be at least as positive as the carrier surface, with the precise choice of materials to be determined by the need to obtain desirable charge sharing, and a reasonable charge level. Examples 3, 4 and 5 demonstrate that progressively more positive toner resin blends when mixed with the same carbon black pigment, and carrier polymer, all charge share, although their charge levels are progessively more positive.

The positive charge contained on the toner particles is generally equally divided between the toner polymer and the conductive patches or pigments; however, for optimum results it is desirable that the conductive patches or pigment dominate the charging, that is, that such patches contain the bulk of or major portion of the charge of example, about 50 percent or more, and up to and exceeding 90 percent of the positive charges, as this will enable the charged toner particles to provide sufficient positive charges to the uncharged toner particles.

In general both the conductive particles or pigments, and toner resin are physically, and electrically available at the surface of the polymer mixture. When both are available the distribution of charge is determined by the relative ordering in the triboelectric series. For positive charge-sharing the conductive pigment should be high enough above the toner polymer in the triboelectric series to dominate the charging, and also sufficiently far removed from the carrier surface in the same series to produce the desired charge level.

The amount of conductive particles present on the surface of the toner particles is of some importance, however, generally only an amount sufficient so as to accomplish the objectives of the present invention is neded. Generally, it is not necessary nor desirable that the entire toner particle surface be coated with the conductive particles, rather, such particles are present on each resin toner particle in a series of patched areas, thus leaving areas on the toner resin which do not contain the conductive particles, so that the surface of the toner particles a whole is insulative, not conductive. About 10 percent of the toner resin surface contains conductive particles, however, as little as 1 percent of the toner resin particle may contain the conductive surface residing particles, and percentage coverage may approach but should not reach that giving a conductive surface. More specifically, each toner particle contains from about 5 percent to about 15 percent of the conductive surface residing particles. The thickness of the conductive particles contained on the toner particle surface ranges from about 10 millimicrons to about 1 micron, and preferably from about 25 millimicrons to about 0.5 microns. However, thickness is not a critical parameter to be concerned about providing the electrical properties of the system are not adversely affected.

In negatively charged toners a highly oxidized carbon black pigment is often utilized with a resin, such as a polyester or styrene-n-butyl methacrylate. In this situation, the pigment is situated below the resin polymer in the triboelectric series. Also, the oxidized carbon blacks are usually poorly dispersing in the resin mentioned; thus the blacks form large chunks which are exposed when the toner is attritted. The exposure of the black and the extreme position of the black in a triboelectric series causes the black to dominate the charging. However, when this same toner is driven positive by using a carrier polymer very low in the triboelectric series, contact charging interactions tend to drive charge onto the toner polymer rather than onto the carbon black, since the toner polymer is now at the extreme of the triboelectric series of carrier, toner pigment and toner polymer. The resulting developer composition is positively charged, but does not charge share, as indicated by the high admix time of 10 minutes, reference Example I.

The conductive particles can be attached to the toner particles, or embedded in its surface. Numerous methods of attachment and embedding are known, thus for example, the conductive particles may be blended with the toner polymer and the resultant composite attrited to form toner particles. In this situation, the conductive particles or pigment must be electrically available near the surface of the toner resin since often the blending process covers the pigment with a layer of polymer sufficiently thick, that no communication with the carrier, or with other toner particles is possible. It may be necessary to deliberately create poor dispersions so that some of the pigment is exposed on attriting. Nevertheless, as the polymer and conductive particles will be competing for charge from the carrier. Thus, such particles should be triboelectrically more positive than the toner polymer.

Another method of attachment is to cover the surface of a toner particles with the conductive material by mechanical blending, followed by exposing it to high temperatures in an air column. This process fixes the conductive material to the surface.

The level of positive charge intensity acquired by the uncharged toner particles being added to the system, and the charged toner particles already present in the system ranges from about 5 microcoulombs/gram to about 50 microcoulombs/gram, (uc/g) and preferably from about 10 uc/g to about 30 uc/g. This level of charge intensity must be at a minimum of about 5 uc/g in order for the system to properly operate. The unused charged toner particles already present in the system, and contained on the carrier particle, generally have a charge in the range of about 10 uc/g to about 30 uc/g. When new uncharged toner material is added to the charged developer composition, all the toner particles at each size acquire the same level of charge; therefore, the toner particles already charged have their charge level lowered somewhat, each toner particle contributing charges to the new uncharged toner particles being added to the system. Therefore, there thus results charge-sharing and the charges are being shared between the charged toner particles present in the system and the uncharged toner particles being added to the system. While the charge level is essentially lowered this does not adversely affect the imaging system in that sufficient charge is present on all the toner particles to allow them to be controlled electrically, and to be attracted to the carrier or to the electrostatic latent image and therefore develop that image. After a short period of time, the toner particles may acquire further charged from the carrier particles in view of the triboelectric relationship between the carrier and toner particles, which triboelectric relationship has been discussed herein. Accordingly, as a result of charge sharing, and the triboelectric relationship between the toner and carrier particles, the toner particles maintain their charge level.

Developer compositions which exhibit features of the present invention provide rapid positive admix charging by charge-sharing between toner particles already charged, and freshly added uncharged toner particles, rather than by the rapid charging of freshly added uncharged toner by contact with the carrier surface. The distinction between these modes of admix charging is illustrated in Examples II and V.

Numerous different types of materials may be used as the toner resin providing they accomplish the objective of the present invention, however, typical resins include polyamides, epoxies, polyurethanes, vinyl resins, and polyester, especially those prepared from dicarboxylic acids and diols comprising diphenols. Any suitable vinyl resin may be employed, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such a vinylidene chloride, vinylidene chlorofluoride and the like; and N-vinyl indoles, N-vinyl pyrrolidene and the like; and mixtures thereof.

Generally toner resins containing a relatively high percentage of styrene are preferred. The styrene resin employed may be a homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Any suitable carrier material can be employed as along as such carrier particles are capable of triboelectrically obtaining a charge of polarity opposite to that of the toner particles. In the present invention in one embodiment that would be a negative polarity, so that the toner particles will adhere to and surround the carrier particles. Thus, the carriers can be selected so that the toner particles acquire a charge of a positive polarity, and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. Nos. 2,618,441, 2,638,522; 3,618,522; 3,591,503, 3,533,835 and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1,000 microns, thus allowing the carrier to possess sufficient density and inertia to avoid adherence to the electrostatic images during the development process.

The carrier may be employed wth the toner composition in any suitable combination, however, best results are obtained when about 1 part per toner is used, to about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor, and this usually occurs with organic photoreceptors, illustrative examples of such photoreceptors being polyvinyl carbazole, 4-dimethylaminobenzylidene, benzhydrazide; 2-benzylidene-amino-carbazole, 4-dimethylamino-benzylidene, benzhydrazide; 2-benzylidene-aminocarbazole, polyvinyl carbazole; (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinyl carbazole-trinitrofluorenone charge transfer complex, phthalocyanines, layered photoresponsive devices containing a charge injecting, and charge generating layer, and the like.

The following Examples are being supplied to further define the species of the present invention, it being noted that these Examples are intended to illustrate and not limit the scope of the present invention. Parts and percentages are by weight unless otherwise indicated.

EXAMPLE I

There was prepared a toner composition by melt blending, 95 percent by weight of the epoxy resin Epon 1004, a polymer commercially available from Shell Oil, and 5 percent by weight Raven 1020 carbon black commercially available from Columbian Chemicals Company, followed by attriting the resultant composite. This toner composition was then blended with a carrier consisting of a ferrite core coated with the halogenated polymer FPC461, a fluorinated polyvinyl copolymer commercially available from Firestone Plastics Co. The admix time of the developer composition, as measured by a charge spectrograph was ten minutes, which admix time indicates that no charge sharing resulted.

With reference to FIG. 3, the toner polymer of this Example, or epoxy resin is more positive triboelectrically than both the carrier coating, and the conductive Raven 1020 carbon black, hence it does not satisfy the criteria of the present invention wherein the carbon black must be more positive triboelectrically than the toner polymer in order to obtain charge sharing.

EXAMPLE II

A carrier core of steel was coated with a methyl terpolymer, comprised of polymer of 80.9 percent methylmethacrylate, 14.3 percent styrene, and 4.8 percent vinyltriethoxysilane. Against this carrier the toner of Example I is driven triboelectrically negative. Since the Raven 1020 carbon black is more negative than the toner resin, reference FIG. 3, it receives the bulk of the charge, and negative charge sharing, but not positive charge sharing, occurs. The charge admix time of this developer, as measured by the charge spectrograph, is 15 seconds, which rapid admix time indicates that negative charge sharing resulted.

When the same developer composition is prepared from fresh toner and fresh carrier, in the same proportions, about 15 minutes of mixing is required to reach its equilibrium charge, much longer than the 15 seconds needed to charge toner added to already mixed developer. Thus, the fresh toner particles are slowly charged by the carrier particles.

EXAMPLE III

A toner was prepared by blending 90 percent by weight of the halogenated polymer FPC471, a fluoropolymer available from Firestone Plastics, and 10 percent Elftex 8, a carbon black available from Cabot Corporation, and attriting the resultant composite. This toner was blended with the FPC461 coated carrier of Example I and a similar admix experiment was performed. The FPC471 and FPC461 polymers are similar in triboelectric character, reference FIG. 3, while Elfex 8 is positioned above both materials in the triboelectric series, enabling this carbon black to dominate the charging, thus satisfying the criteria of the present invention.

The measured admix time for this developer composition was 15 seconds, indicating that positive charge sharing resulted, and the charge intensity for the toner particles was 21 microcoulombs per gram.

EXAMPLE IV

A toner was prepared by blending 75 percent FPC471, 15 percent Epon 1004 and 10 percent Elftex 8, and attriting. When blended with the carrier of Example III, the admix time was 15 seconds, indicating that the resin composite was more negative than the conductive carbon black pigment Elftex 8, which admix time also indicated positive charge sharing resulted.

EXAMPLE V

A toner was prepared and examined in accordance with the procedure of Example III, with the exception that the toner composition consisted of 60 percent FPC471, 30 percent Epon 1004 and 10 percent Elftex 8, which toner was triboelectrically positive, and the admix time was 15 seconds, indicating charge sharing resulted. The same developer composition was prepared by combining toner and fresh carrier, and then mixed by blending on a roll mill. After 5 minutes of mixing, the charge level of the developer composition achieved 90 percent of its equilibrium value. The negative admix time of the toner composition of this Example with methyl terpolymer coated carrier was 8 minutes.

EXAMPLE VI

A toner was prepared by blending Pliolite, a styrene-butadiene copolymer available from Goodyear Chemical Company, and Regal 330, a carbon black available from Cabot Corporation. This toner was milled with Aerosil, a fine silica powder available from DeGussa Corporation. The resultant material was passed through a heated air column to fix the material, and any remaining free material was blown away. Photographs (SEM) revealed the toner surface uniformly covered with Aerosil; hence there is no conductive material thereon. Admixing performed in the same manner as Example I with the same carrier as Example I resulted in an admix time of 5 minutes.

EXAMPLE VII

A toner was prepared in accordance with of Example VI, with the exception that Raven 420, a carbon black available from Columbian Chemicals Company, was milled onto the surface simultaneously with the Aerosil. The surface now contains conductive particles of carbon black, which are more electropositive than Aerosil. The admix time of this toner with the carrier of Example I is 15 seconds, indicating the positive charge sharing resulted.

EXAMPLE VIII

A toner was prepared in accordance with Example VII with the exception that ZYP powder, a 12 percent solid solution of yttrium oxide in zirconium oxide available from Zircar, Inc. was substituted for the Raven 420 carbon black. The ZYP powder is conductive, and more electropositive than Aerosil. The admix time of this toner with the carrier of Example I is 1 minute, indicating that positive charge sharing resulted.

EXAMPLE IX

A toner was prepared in accordance with Example V with the exception that there was substituted for the Pliolite resin, a toner polyester resin, comprised of the reaction product of bisphenol A, propylene glycol, and fumaric acid. The surface was again coated with Aerosil, and heat spheroidized. Photographs (SEM) revealed the toner surface was uniformly covered with Aerosil; hence there is no conductive material thereon. The toner of this Example had a 15 minute admix time with the carrier of Example I, indicating that no charge sharing resulted.

EXAMPLE X

A toner was prepared in accordance with Example IX with the exception that Raven 420 was milled onto the surface simultaneously with the Aerosil. The toner of this Example had an admix time with the carrier of Example I, of 15 seconds, indicating that charge sharing resulted.

EXAMPLE XI

A toner was prepared in accordance with Example IX, with the exception that ZYP powder was milled onto the surface simultaneously with the Aerosil. The toner of this Example had an admix time of 1 minute with the carrier of Example I, indicating that positive charge sharing resulted.

Other modifications of the present invention may occur to those skilled in the art based upon a reading of the present disclosure and these are intended to be included within the scope thereof.

What is claimed is:

1. A process for rapidly charging uncharged toner particles to a positive polarity, which comprises adding uncharged toner particles to a positively charged developer composition comprising carrier particles and toner particles, the charged and uncharged toner particles containing conductive particles or conductive patches embedded in the surface thereof in an amount of from about 5 percent to about 15 percent thereby retaining the electrically insulating characteristics of the toner composition, which conductive patches are of a higher positive triboelectric charge than the toner polymer, contacting the charged toner particles with the uncharged toner particles causing positive charges to be transferred from the conductive particles on the charged toner particles, to conductive particles on the uncharged toner particles, within a period of from about 5 seconds to about 2 minutes, thereby resulting in substantially the same level of positive charge intensity for both the original charged toner particles and the added toner particles, such charge intensity ranging from about 5 microcoulombs per gram to about 50 microcoulombs per gram.

2. A process in accordance with claim 1 wherein the conductive particles are selected from carbon black, yttrium oxide-doped zirconium oxide, or magnetite.

3. A process in accordance with claim 1 wherein the toner resin is comprised of styrene butylmethacrylate copolymer resins, or styrene butadiene resins.

4. A process in accordance with claim 3 wherein the styrene butylmethacrylate resin is a styrene-n/butylmethacrylate resin containing 65 percent by weight of styrene, and 35 percent by weight of n-butylmethacrylate, the styrene butadiene resin contains 90 percent by weight of styrene and 10 percent by weight of butadiene.

5. A process in accordance with claim 1 wherein the uncharged toner particles acquires a positive charge in a period of from about 5 seconds to about 1 minute, such charge ranging from about 10 microcoulombs per gram to about 30 microcoulombs per gram.

6. A process in accordance with claim 1 wherein the conductive particles range in resistivity from about $10^9$ ohms-cm to about $10^{-6}$ ohms-cm, which particles have a size within the range of from about 0.05 microns to about 3 microns.

7. A process in accordance with claim 1 wherein the conductive particles contain a major portion of the positive charge thereon, said conductive particles being triboelectrically more positive than the toner resin polymer, said toner resin polymer being triboelectrically more positive than the carrier surface.

8. A process in accordance with claim 1 wherein said conductive particles contain the bulk of the positive charge, said particles being triboelectrically more positive than the carrier surface, and said toner resin polymer being triboelecrically neutral with regard to the carrier surface.

9. A process for rapidly charging uncharged toner particles to a positive polarity which comprises adding uncharged electrically insulating toner particles to a positively charged developer composition comprising carrier particles and electrically insulating toner particles, the charged and uncharged toner particles having embedded in their surface and attached thereto conductive particles selected from carbon black, yttrium oxide-doped zirconium oxide, or magnetite, which conductive particles are at a higher positive triboelectric charge than the toner polymer resin, followed by contacting the insulating charged toner particles with the insulating uncharged toner particles, causing positive charges to be transferred from the conductive particles on the charged toner particles to conductive particles on the uncharged toner particles, within a period of from about 5 seconds to about 2 minutes, thereby resulting in substantially the same level of positive charge intensity for both the original charged insulating toner particles and the added insulating toner particles, such charge intensity ranging from about 5 microcoulombs per gram to about 50 microcoulombs per gram, and wherein further charges are transferred to the uncharged toner particles by the carrier particles in view of the triboelectric relationship thereof, each toner particle containing from about 5 percent to about 15 percent of the conductive particles the thickness thereof ranging from about 10 millimicrons to about 1 micron.

* * * * *